US012601130B2

(12) United States Patent
Swiontek et al.

(10) Patent No.: US 12,601,130 B2
(45) Date of Patent: Apr. 14, 2026

(54) MOVABLE BACK DRAG BLADE FOR SNOW BLOWER

(71) Applicant: PALADIN BRANDS GROUP, INC., New Britain, CT (US)

(72) Inventors: Jason Swiontek, Jackson, MI (US); Justin Perkins, Chelsea, MI (US)

(73) Assignee: Paladin Brands Group, Inc., Delhi, IA (US)

( * ) Notice: Subject to any disclaimer, the term of this patent is extended or adjusted under 35 U.S.C. 154(b) by 1089 days.

(21) Appl. No.: 17/672,898

(22) Filed: Feb. 16, 2022

(65) Prior Publication Data

US 2023/0257952 A1 Aug. 17, 2023

(51) Int. Cl.
*E01H 5/09* (2006.01)
*E01H 5/06* (2006.01)

(52) U.S. Cl.
CPC ..... *E01H 5/098* (2013.01); *E01H 5/06* (2013.01)

(58) Field of Classification Search
CPC ..... E01H 5/098; E01H 5/06; E01H 5/062; E01H 5/063; E01H 5/061; E01H 5/045; E01H 5/04; E01H 5/066; E01H 5/068
See application file for complete search history.

(56) References Cited

U.S. PATENT DOCUMENTS 4,023,287 A * 5/1977 de Brito ..... E01H 5/04 37/231
5,072,531 A 12/1991 Pronovost et al.
6,154,985 A * 12/2000 Champagne ..... E01H 5/098 37/222
6,470,604 B1 * 10/2002 Foster ..... E01H 5/06 37/406
6,640,468 B2 * 11/2003 Menze ..... E01H 5/06 37/234
6,996,925 B2 2/2006 Harding
7,543,401 B2 * 6/2009 Hughes ..... E01H 5/068 37/232
8,191,288 B2 6/2012 Weagley et al.
9,032,650 B2 * 5/2015 Iacona ..... E01H 5/04 37/231
9,663,910 B2 * 5/2017 Muntasser ..... E04D 13/106
10,106,942 B2 10/2018 Roberge
10,788,837 B2 * 9/2020 Wilson ..... G05D 1/0219
11,111,643 B2 9/2021 Bergman
(Continued)

FOREIGN PATENT DOCUMENTS

CA 2224443 A1 * 7/1999 ..... E01H 5/098

*Primary Examiner* — Nicole Coy
*Assistant Examiner* — Blake E Scoville
(74) *Attorney, Agent, or Firm* — Nyemaster Goode, P.C.

(57) ABSTRACT

A snow blower device having a housing forming a cavity configured to receive snow. A rotatable auger is supported by the housing and positioned within the cavity to gather and direct snow into a discharge chute having a lumen extending from the inside of the housing to the outside of the housing. The device further includes a blade combined with the frame and movable between a retracted position and an engaged position. In the retracted position the blade is positioned to let the snow reach the auger when the snow blower is moved in the forward direction. In the engaged position the blade is moved downward so that it contacts the ground surface and functions as a plow or snow push when the snow blower is moved in a backward direction.

19 Claims, 8 Drawing Sheets

(56) References Cited

U.S. PATENT DOCUMENTS

| | | | | |
|---|---|---|---|---|
| 2004/0006895 | A1 | 1/2004 | Schultz et al. | |
| 2004/0060200 | A1 | 4/2004 | Schmeichel | |
| 2008/0244935 | A1 | 10/2008 | Crimmins | |
| 2012/0079749 | A1 | 4/2012 | Dimario | |
| 2013/0298429 | A1* | 11/2013 | Niemela | E01H 5/04 37/242 |
| 2014/0075792 | A1* | 3/2014 | Girouard | E01H 5/098 37/257 |
| 2016/0281310 | A1* | 9/2016 | Muntasser | E04D 15/006 |

* cited by examiner

MOVABLE BACK DRAG BLADE FOR SNOW BLOWER

BACKGROUND

The present invention relates to snow-moving equipment and, more particularly, to powered snow blowers.

Snow blowers are machines that facilitate rapid snow removal. They can dramatically increase the speed at which snow is removed from driveways, sidewalks, roads, paths and the like. Snow blowers typically have a rotating auger positioned within a housing. In a single stage snow blower, the auger conveys the snow to the center where the auger projects the snow through a vertical duct or chute. Some snow blowers incorporate a second stage which further includes an impeller mechanism that propels the snow with force out of the snow blower. The second stage facilitates the ejection of the snow while allowing the auger to spin a slower speed.

Some types of snow blowers may be guided by hand and may be sized similar to a walk-behind lawn mower. In other cases, larger snow blowers are mounted to prime mover vehicles such as tractors or skid-setter loaders. The mounted snow blowers may utilize a power take off (PTO) shaft which takes power from the engine of the prime mover to drive the components of the snow blower. Other types of mounted snow blowers receive power through a hydraulic system of the prime mover.

One problem with existing snow blowers is that the rotating auger is positioned behind a forwardmost portion of the housing. As the snow blower approaches an obstacle such as a garage or parked car, the forward movement of the snow blower must stop to prevent the housing from hitting the obstacle before the spinning auger can gather snow between the auger and the obstacle. This leaves an amount of unblown snow between the auger and the obstacle. The snow blower is then moved backward away from the obstacle. A plow blade or a shovel must be used to remove the unblown snow near the obstacle. To help overcome this problem operators usually try to position the snow blower as close to obstacles as possible. However, it can be difficult for the operator to determine when they are too close to obstacles, which can sometimes lead to damage if the snowblower contacts the obstacle.

There is therefore a need for an improved snow blower which overcomes these and other problems in the art.

SUMMARY

One aspect of the invention relates to a snow blower device having a housing with opposing end portions combined by one or more lateral portions. The opposing end portions and one or more lateral portions form a cavity having an inside and an outside, and the one or more lateral portions have an opening therein. A rotatable auger is combined with the housing to direct snow into a discharge chute having a lumen extending from the inside of the cavity to the outside of the cavity. A blade is combined with the frame by an attachment assembly. The blade is movable between a retracted position wherein the blade is raised and an engaged position wherein the blade is lowered and configured to plow snow. A portion of the attachment assembly extends through the opening in the one or more lateral portions of the housing.

Another aspect of the invention relates to a snow blower device. The snow blower may be a standalone machine having its own engine or it may be an attachment configured to be attached to and powered by a prime mover vehicle. The device includes a housing having opposing end portions combined by one or more lateral portions, which lateral portions may include a top portion and a rear portion. The housing end portions and one or more lateral portions form a cavity. The housing has an opening along its forward end configured to receive snow into the cavity as the device is moved in a forward direction across a ground surface. A rotatable auger is combined with the housing and positioned within the cavity to gather and direct snow into a discharge chute having a lumen extending from the inside of the housing to the outside of the housing. The auger is driven by a power source such as an engine or motor, which may be a gasoline engine or a motor hydraulically powered by the hydraulic system of a prime mover vehicle. The device further includes a blade combined with the frame by an attachment assembly having an intermediate member and an actuator. The blade is movable between a retracted position and an engaged position. In the retracted position the blade is positioned to let the snow reach the auger when the snow blower is moved in the forward direction. In the engaged position the blade is moved downward ahead of the auger so that it functions as a plow or snow push to push or drag an amount of unblown snow in front of the auger. In some embodiments the actuator is combined with an external rear portion of the housing so that the attachment assembly extends from the blade, through an opening in one of the lateral portions of the housing, and is attached to the actuator. In this manner the attachment assembly is nested within the cavity of the frame. In some embodiments the blade has a width that is less than the width of the housing. In some embodiments there are two attachment assemblies combined with different portions of the blade, and the distance between the attachment assemblies is less than the width of the housing so that both attachment assemblies are nested within the housing.

Another aspect of the invention relates to a snow blower device. The snow blower device may be a standalone machine having its own engine or it may be an attachment configured to be attached to and powered by a prime mover vehicle. The device includes a housing having opposing end portions combined by one or more lateral portions, which lateral portions may include a top portion and a rear portion. The housing has an opening in its forward end configured to receive snow into the housing cavity defined by the end portions and one or more lateral portions as the device is moved in a forward direction across a ground surface. A rotatable auger is combined with the housing and positioned within the housing cavity to gather and direct snow into a discharge chute having a lumen extending from the inside of the housing to the outside of the housing. The auger is driven by an engine or motor, which may be a gasoline engine or a motor hydraulically powered by the hydraulic system of a prime mover vehicle. The device further includes a blade combined with the frame by an attachment assembly having an intermediate member and an actuator. The blade is movable between a retracted position and an engaged position. In the retracted position the blade is positioned to let the snow reach the auger when the snow blower is moved in the forward direction. In the engaged position the blade is moved downward ahead of the auger so that it functions as a plow or snow push to push or drag an amount of unblown snow in front of the auger. The snow blower further includes a sensor used to determine when a portion of the snow blower is a predetermined distance from an obstacle such as a house, light pole, garage door, or car. Upon determining that the snow blower is the predetermined distance from the obstacle, a visible or audible indicator will notify the operator, prompting the operator to move the blade to the engaged position and move the unblown snow to a desired location.

Another aspect of the invention relates to a method of using the snow blower device described above. The snow blower may be operated in the forward direction to use the auger to gather and/or blow snow out of the chute. Then, as the snow blower approaches an obstacle such as a house or car, the forward movement of the snow blower is stopped leaving an amount of unblown snow between the auger and the obstacle. The blade is moved to its engaged position to capture the amount of unblown snow and push or drag the unblown snow to a desired location. Some embodiments further include using a sensor to alert the operator that the snow blower is a predetermined distance away from an obstacle. The sensor may be electronic and programmed to receive a signal. Upon receipt of the signal the operator moves the blade to the engaged position and operates the snow blower to push or drag the unblown snow to a desired location.

DETAILED DESCRIPTION

Figure 4:
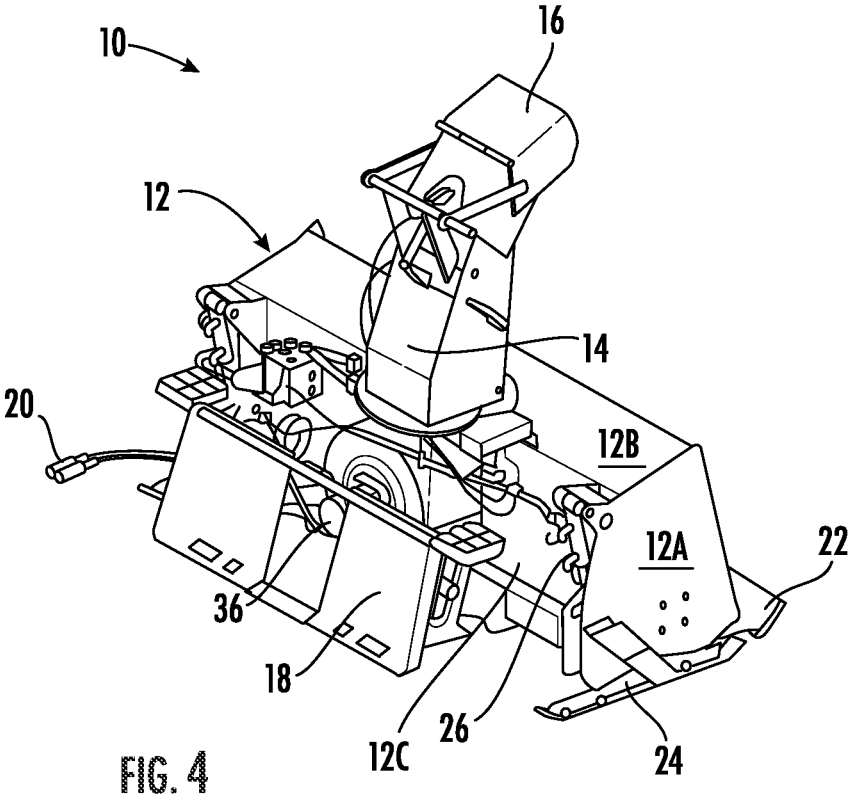
FIG. 4 is a rear perspective view of the snow blower wherein the blade is in the engaged position.
Figure 5:
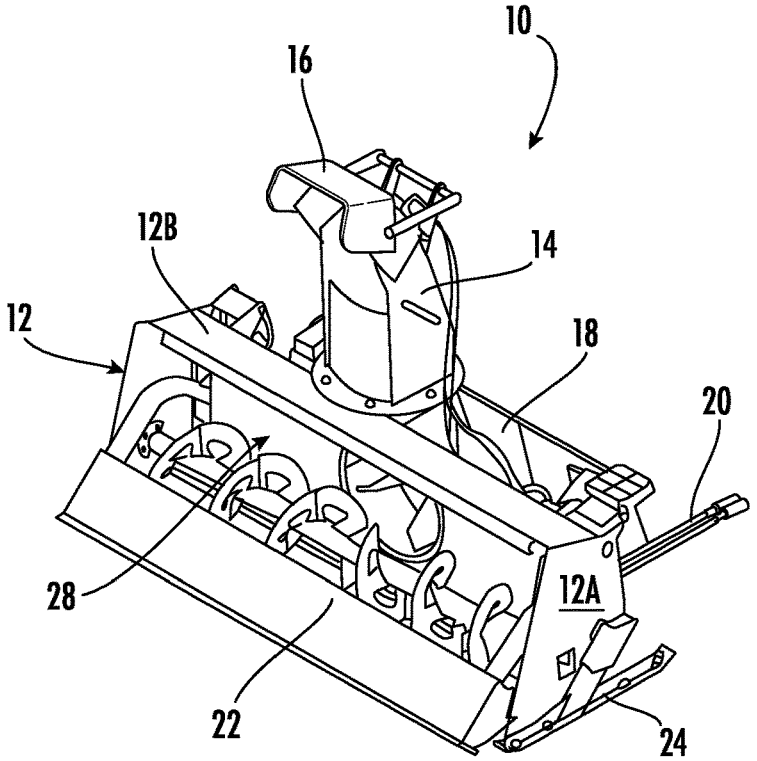
FIG. 5 is a front perspective view of the snow blower wherein the blade is in the engaged position.
Figure 6:
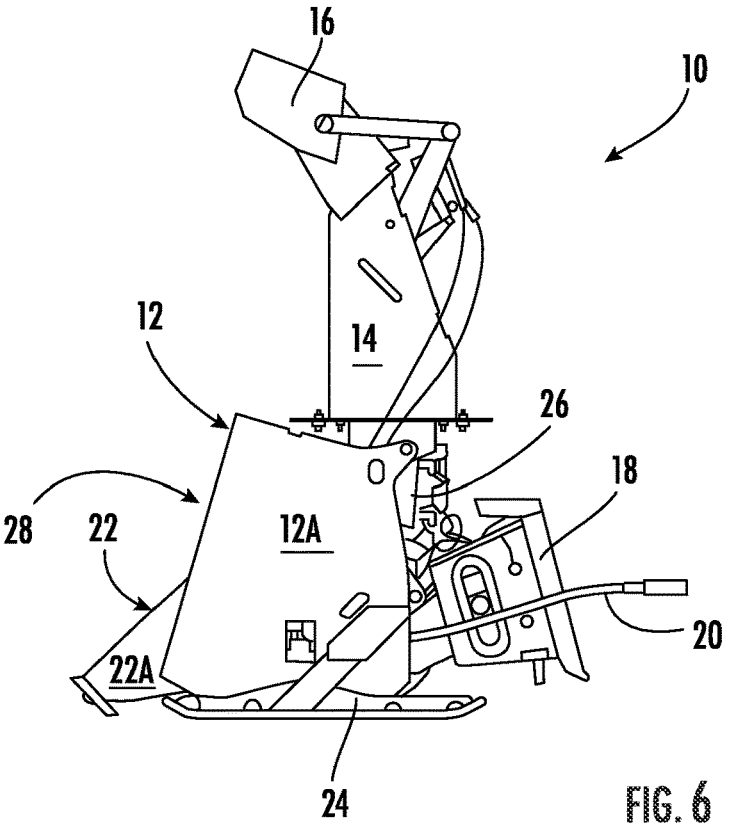
FIG. 6 is a side view of the snow blower wherein the blade is in the engaged position.

As shown in FIGS. 1-6, the invention generally relates to a snow blower 10 device having a housing 12 combined with a blade 22. The blade 22 is movable between a retracted position (FIGS. 1-3) and an engaged position (FIGS. 4-6). In some embodiments the blade 22 may pivot around a pivot axis A as it moves between the retracted position and the engaged position. The figures illustrate the snow blower 10 device as an attachment configured to be powered by and combined with a prime mover vehicle such as a tractor or skid steer loader by an attachment assembly 18, however, the snow blower 10 device may also be a standalone machine having its own engine. The snow blower 10 device is movable over a ground surface by wheels or any other suitable means. In some embodiments skid skis 24 are combined with a lower portion of the housing 12 and configured to slide over the ground surface. The skid skis 24 may have a replaceable wear pad which may be removed and replaced when it wears out. The skid skis 24 may also include an adjustment means which allows the position of the skid skis 24 to adjust relative to the housing 12 so that the housing 12 can be positioned at different distances from the ground surface.

As shown in FIGS. 1-6, the snow blower 10 includes a housing 12 having opposing end portions 12A combined by one or more lateral portions, which lateral portions may include a top portion 12B and a rear portion 12C. The housing end portions 12A and one or more lateral portions 12B, 12C form a cavity 28. The housing 12 has an opening in its forward end configured to receive snow into the cavity 28 as the snow blower 10 is moved in a forward direction across the ground surface. A rotatable auger 30 is supported by the housing 12 and positioned within the cavity 28 to gather and direct snow into a discharge chute 14 having a lumen extending from the inside of the housing 12 to the outside of the housing 12. The discharge chute 14 may have one or more articulating deflectors 16 near its discharge end to help control the direction snow is discharged from the chute 14. The articulating deflectors 16 may be adjustable by any suitable means, including manually, or by a linkage assembly powered by a hydraulic cylinder or electric motor.

The auger 30 is driven by a suitable power source 36, such as an engine or motor. The power source 36 may be a gasoline engine, a PTO of a prime mover vehicle, or a motor hydraulically powered by the hydraulic system of a prime mover vehicle. The embodiment shown in FIGS. 1-6 includes hydraulic lines 20 for connecting the power source 36 (a hydraulic motor) to the hydraulic system of a prime mover vehicle.

As mentioned above, the device further includes a blade 22 combined with the housing 12 and movable between a retracted position (FIGS. 1-3) and an engaged position (FIGS. 4-6). In the retracted position the blade 22 is positioned to let snow into the cavity 28 to reach the auger 30 when the snow blower 10 is moved in the forward direction. In the engaged position the blade 22 is moved downward and extends a predetermined distance ahead of the auger 30 so that the blade 22 functions as a plow to push or drag an amount of unblown snow when the snow blower 10. The unblown snow is in front of the auger 30 and not able to be reached by the auger 30 since the auger 30 is positioned within the housing 12, but the unblown snow is close enough to the snow blower 10 that it can be captured by the blade 22 (i.e., the unblown snow is between the blade 22 and the auger 30) when the blade 22 is moved to its engaged position. The blade 22 may include end walls 22A similar to a snow push to give the blade a volume to collect snow which helps prevent snow from escaping around the ends of the blade 22. The blade 22 may also include a replaceable ground engaging lip which may be made of a rubber or plastic material.

Figure 7:
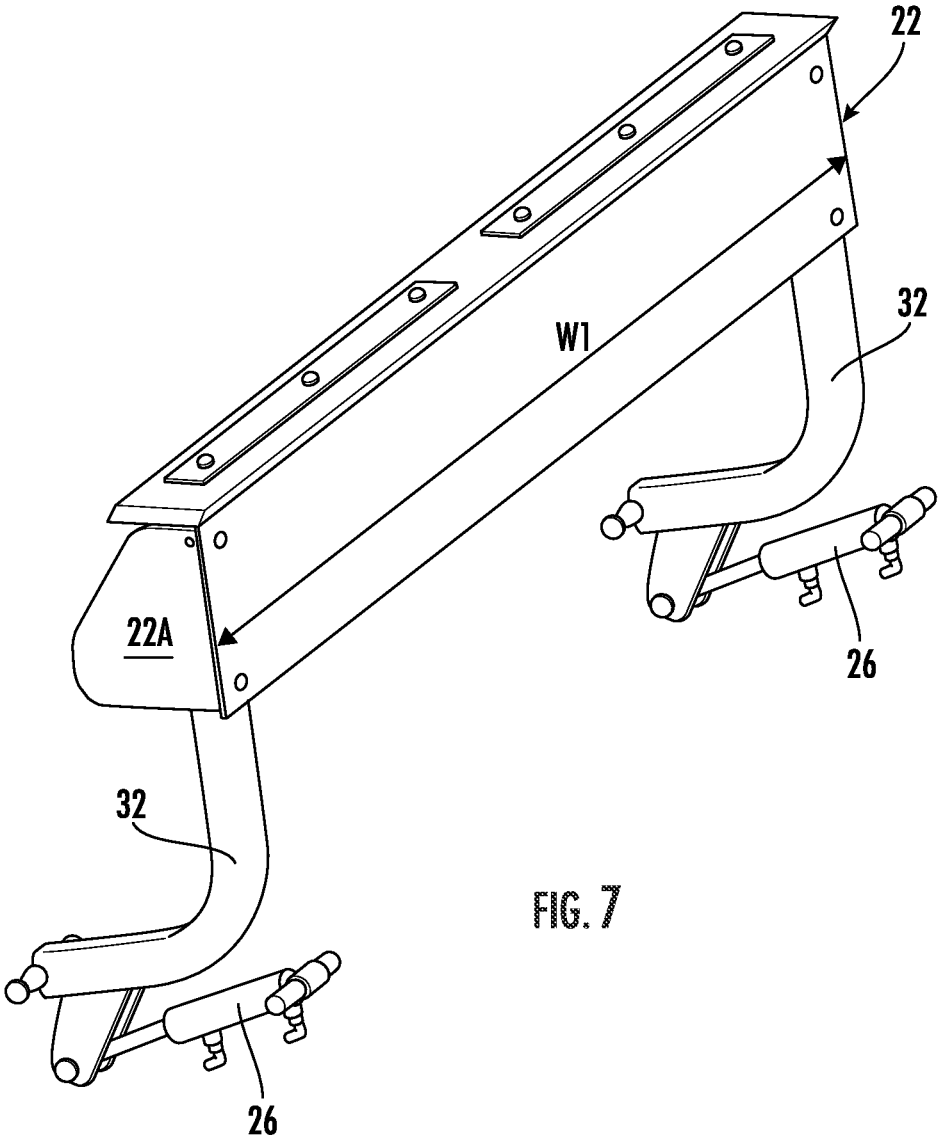
FIG. 7 is a perspective view of the blade assembly.

The blade 22 may be moved between the retracted position and the engaged position by an attachment assembly. In some embodiments the attachment assembly comprises an actuator 26 and an intermediate member 32. As shown, there are two attachment assemblies combined with the opposing end portions of the blade 22. FIG. 7 shows the blade 22 and attachment assembly separated from the housing 12. The actuator 26 may be any suitable actuator 26, including a manually actuated linkage assembly, an electric motor, and a hydraulic cylinder. In some embodiments a single actuator 26 is used to drive both attachment assemblies. In the figures the actuator 26 is shown as a hydraulic cylinder, however, it may also be an electric motor or any other suitable power mechanism. The intermediate member 32 has a first end combined with the blade 22 and a second end combined with the actuator 26 and/or the housing 12. A first portion of the actuator 26 is combined with an external portion of the housing 12, such as the rear lateral portion 12C, and another portion of the actuator 26 is combined with the intermediate member 32 or the blade 22 itself such that extension and retraction of the actuator 26 correspondingly moves the blade 22 as the intermediate member 32 pivots around a pivot axis A. Pivot axis A may include a bolt, rod, shaft, or other means for pivotally attaching the intermediate member 32 to the housing 12.

Figure 8:
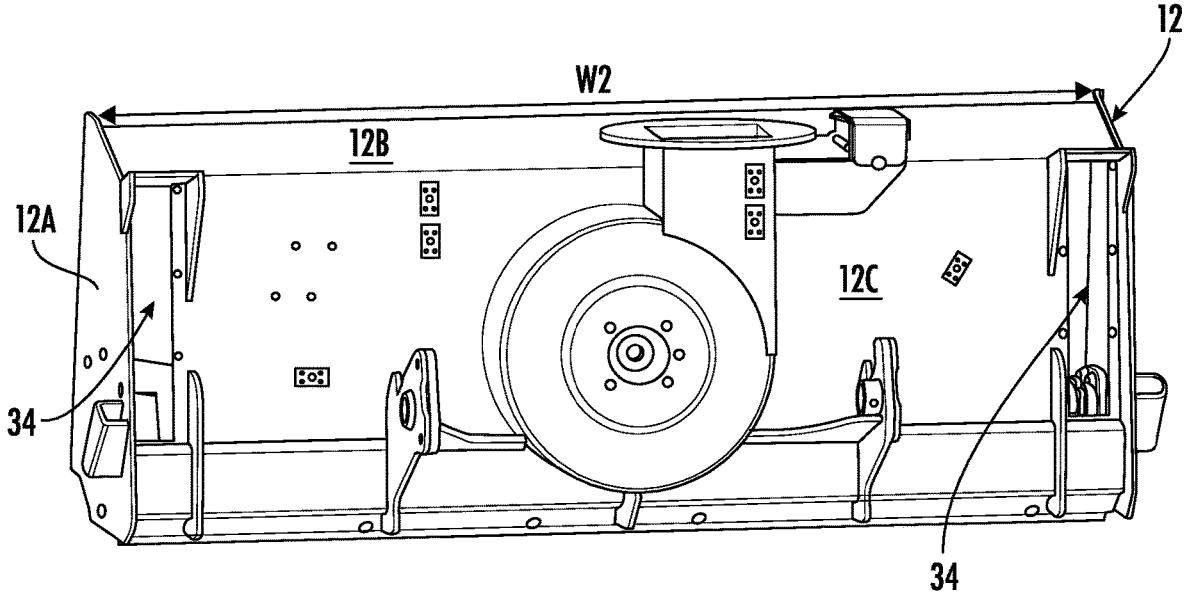
FIG. 8 is a rear view of the snow blower housing decoupled from the blade and other components.
Figure 9:
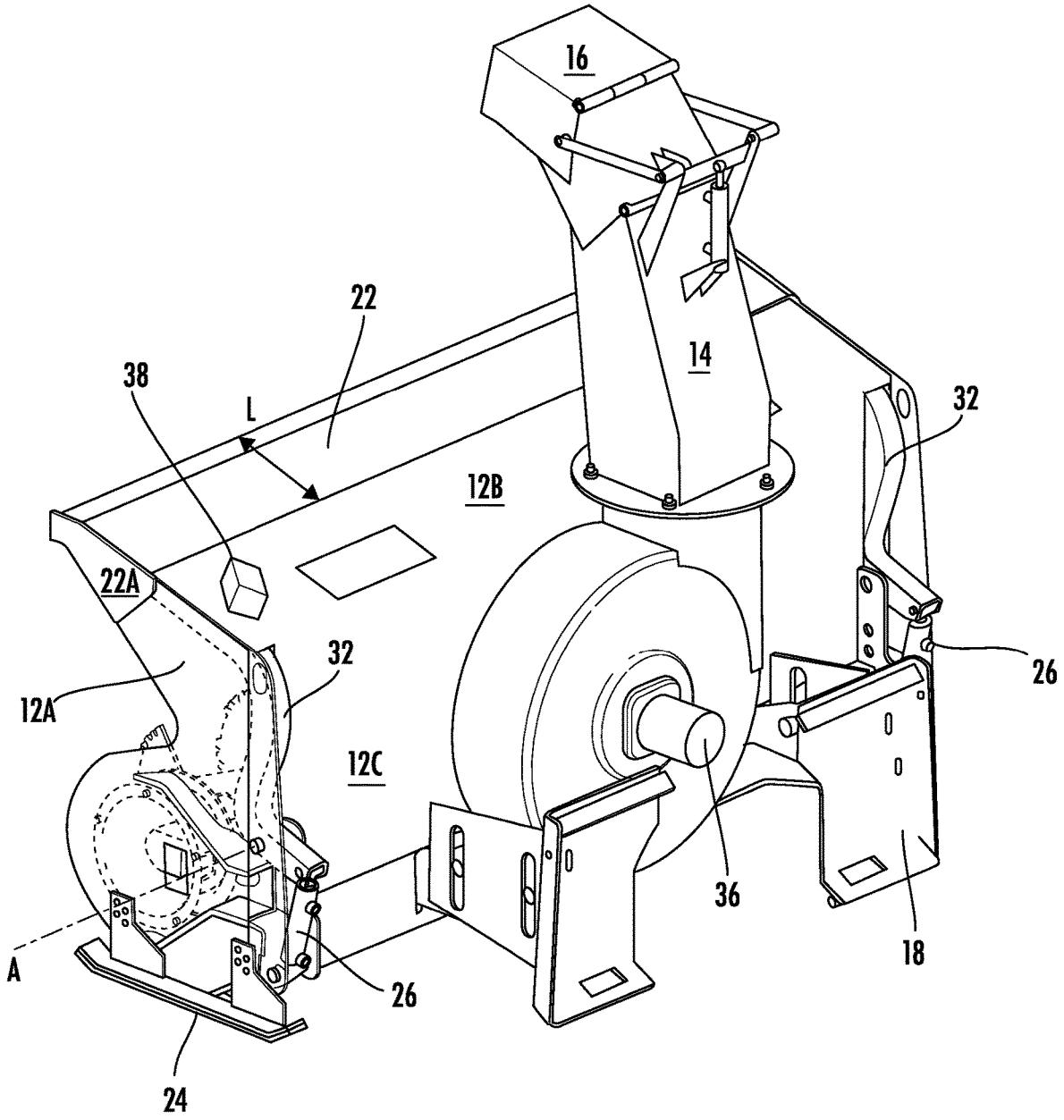
FIG. 9 is a rear perspective view similar to FIG. 1 but showing the attachment assembly in phantom lines inside the housing.
Figure 10:
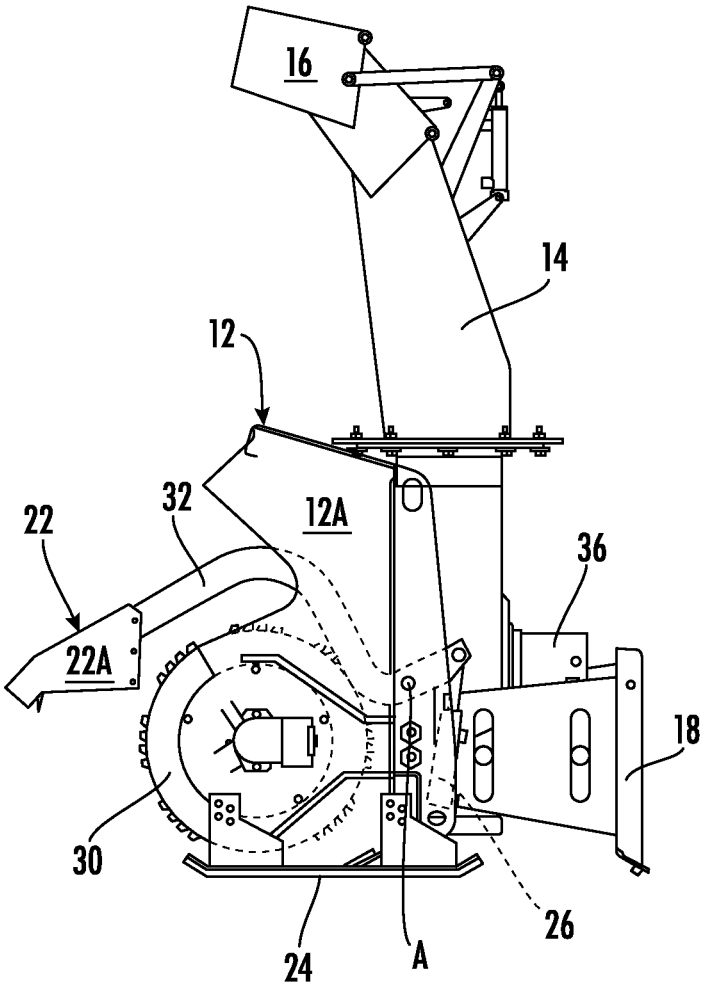
FIG. 10 is a side view showing the blade being moved between the retracted positioned and the engaged position and a portion of the attachment assembly in phantom lines inside the housing.

FIG. 8 shows openings 34 in the rear lateral portion 12C of the housing 12, the openings 34 are configured to receive a portion of the attachment assembly. FIGS. 9 and 10 shows the intermediate members 32 extending through the cavity 28 (between the housing end portions 12A) and through the openings 34 wherein a first portion of an intermediate member 32 is combined with the actuator 26 and a second portion of the intermediate member 32 is combined with the blade 22. The positioning of the intermediate member 32 through the housing 12 helps protect the assembly from damage since it could contact an obstacle if it were positioned on the outside of the housing 12. Further, the openings 34 allows the intermediate members 32 to be combined with the actuator 26 attached to the rear lateral portion 12C of the housing 12 without having to increase the width of the snow blower 10.

Figure 1:
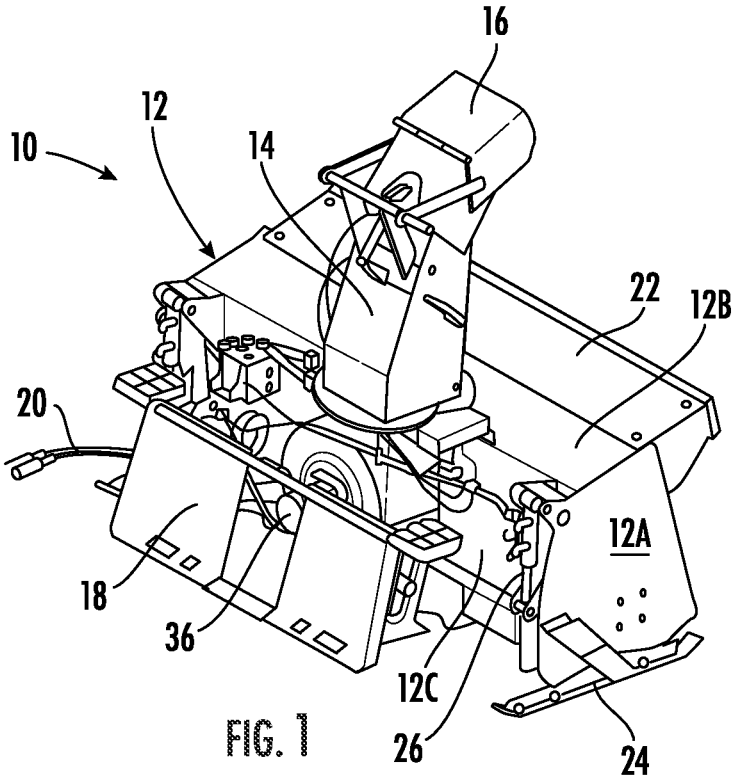
FIG. 1 is a rear perspective view of the snow blower wherein the blade is in the retracted position.
Figure 2:
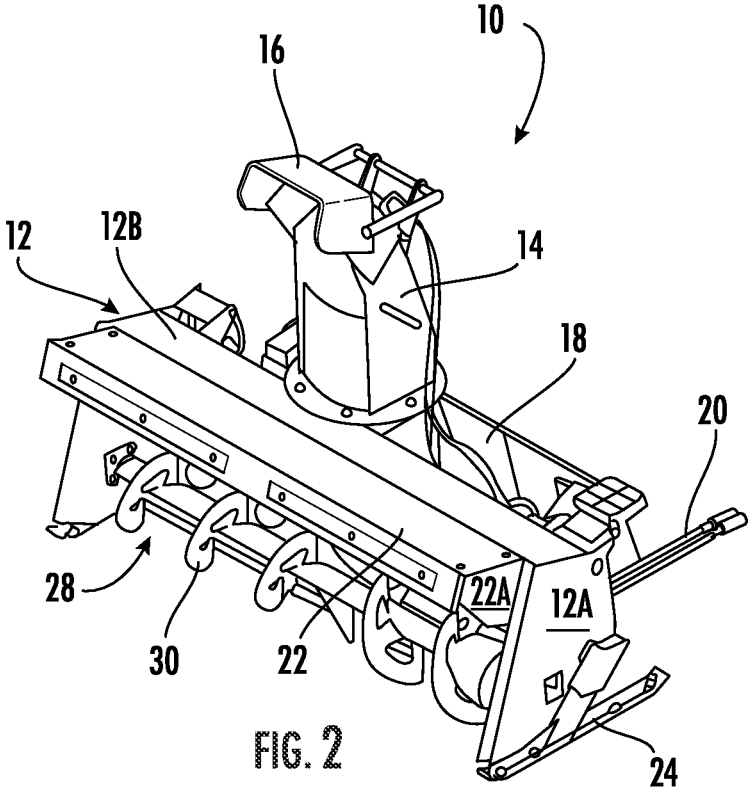
FIG. 2 is a front perspective view of the snow blower wherein the blade is in the retracted position.
Figure 3:
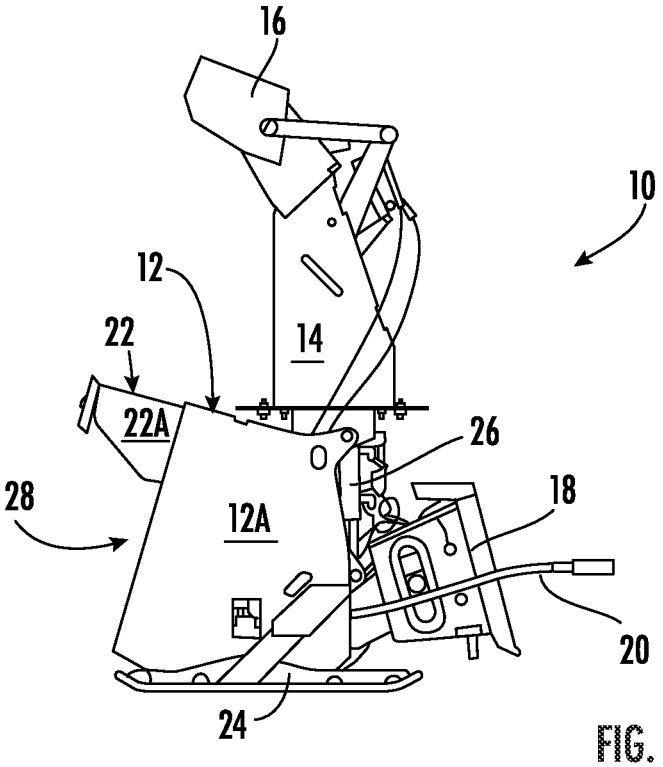
FIG. 3 is a side view of the snow blower wherein the blade is in the retracted position.

As shown in FIGS. 7-9, in some embodiments the blade 22 has a width W1 that is about the same as a width W2 of the housing 12. This allows the blade 22 to be as wide as possible without adding any extra width to the housing 12. In some embodiments the width W1 of the blade 22 is less than the width W2 of the housing 12. In some embodiments there are two attachment assemblies combined with opposing portions of the blade 22. The distance between the first and second attachment assemblies is less than the width of the housing 12 so that the attachment assemblies do not add extra width and can nest inside of the housing 12 in both the extended and retracted positions. Further, as best shown in FIGS. 2 and 9, in some embodiments the blade 22 functions as an extension of the top of the housing 12B when the blade 22 is in the retracted position. In these embodiments the blade 22 includes a generally planar portion which retracts to engage and/or be flush with the top of the housing 12B. This increases the volume of the cavity 28 to help gather snow in the cavity 28 and prevent the auger 30 from throwing snow, rocks, or other debris toward the operator.

Figure 11:
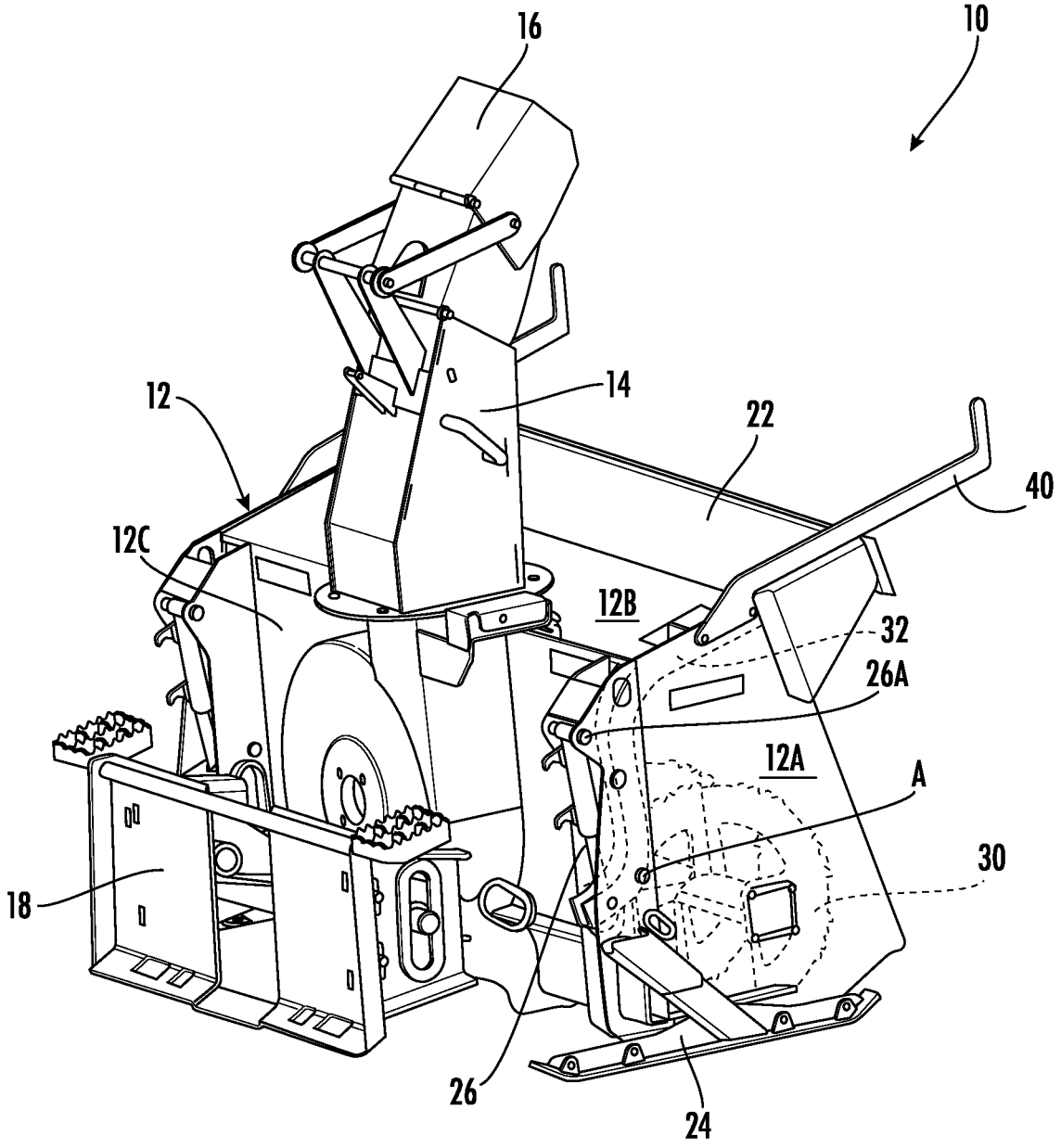
FIG. 11 is a rear perspective view showing an alternate embodiment.

FIGS. 9 and 11 show embodiments further comprising a sensor 38, 40 combined with the snow blower 10 and configured to determine when the snow blower 10 is a predetermined distance from an obstacle such as a house, garage door, or parked car. The sensor shown in FIG. 9 is an electric sensor 38 which may be an ultrasonic proximity sensor. The sensor 40 shown in FIG. 11 is a physical member such as a flexible rod extending forward of the housing 12 a predetermined distance. In embodiments where the sensor 38 is an electronic proximity sensor, the sensor 38 may be controlled by any suitable controller, processor, or programmable logic controller. In some embodiments the predetermined distance is between four and eight inches. In some embodiments the predetermined distance is about six inches. Upon determining that the snow blower is the predetermined distance from the obstacle, a visible or audible indicator will notify the operator, prompting the operator to move the blade 22 to the engaged position and drag the unblown snow to a desired location. In some embodiments the blade extends ahead of the housing 12 (in its engaged position) at a distance that is more than half of the predetermined distance. This allows the sensor 38 to alert the user to prevent the snow blower 10 from getting too close to the obstacle, while also being close enough to the obstacle for the blade 22 to move to its engaged position and capture much of the snow in front of the obstacle. In some embodiments the controller is programmed to prevent the blade 22 from moving to the engaged position if the sensor 38 determines that the housing 12 is too close to the obstacle.

FIG. 11 shows an embodiment wherein the actuator 26 is a hydraulic cylinder. The actuator 26 has a first portion combined with the housing 12 at an attachment point 26A. The rod of the cylinder extends to lift the blade 22 and retracts to lower the blade 22. In this embodiment the attachment point 26A is at a location on the housing 12 that is above the pivot axis A to help decrease pressure to move the blade 22 between the retracted position and the engaged position.

Another aspect of the invention relates to a method of using the snow blower 10 device described above. The snow blower 10 may be operated in the forward direction to use the auger 30 to blow snow out of the chute 14. Then, as the snow blower 10 approaches an obstacle such as a house or parked car, the blade 22 is moved to its engaged position to capture an amount of unblown snow between the blade 22 and the auger 30 then push or drag the unblown snow to a desired location. Some embodiments further include receiving a signal from the sensor 38 to alert the user that the snow blower 10 is a predetermined distance away from an obstacle. Upon receiving the signal, the blade 22 is moved to the engaged position and the operator moves the snow blower 10 in the reverse direction to drag the unblown snow rearward to a desired location. In some embodiments the blade 22 may push the unblown snow by operating the snow blower 10 in the forward direction.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims.

What is claimed is as follows:

1. A snow blower device comprising:

a housing having opposing end portions combined by top lateral portion having a surface and a rear lateral portion having an opening therein, wherein the opposing end portions, the top lateral portion, and the rear lateral portion form a cavity having an inside and an outside, wherein the cavity has a volume;

a rotatable auger combined with the housing to direct snow into a discharge chute having a lumen extending from the inside of the cavity to the outside of the cavity;

a blade combined with the housing by an attachment assembly, the blade being movable between a retracted position and an engaged position, wherein in the retracted position the blade is raised such that a surface of the blade abuts the surface of the top lateral portion of the housing to increase the volume of the cavity, wherein in the engaged position the blade is lowered and configured to engage a ground surface a predetermined distance ahead of the rotatable auger to plow snow the predetermined distance ahead of the rotatable auger when the snow blower is moved;

wherein a portion of the attachment assembly extends through the opening in the rear lateral portion of the housing.

2. The snow blower device of claim 1 wherein the attachment assembly includes an intermediate member and an actuator.

3. The snow blower device of claim 1 wherein the snow blower is an attachment configured to be attached to and powered by a prime mover vehicle.

4. The snow blower device of claim 1 wherein the auger is driven by a hydraulic motor powered by a hydraulic system of a prime mover vehicle.

5. The snow blower device of claim 2 wherein the actuator is a hydraulic cylinder combined with an external rear portion of the housing.

6. The snow blower device of claim 5 wherein the intermediate member has a first end combined with the blade and a second end combined with the actuator.

7. The snow blower device of claim 1 wherein the blade has a width and the housing has a width, and the width of the blade is less than the width of the housing.

8. The snow blower device of claim 2 wherein the intermediate member is pivotably attached to the housing about a pivot axis.

9. The snow blower device of claim 2 wherein the intermediate member is positioned between the opposite end portions of the housing.

10. The snow blower device of claim 1 wherein the surface of the blade is a generally planar portion that abuts the surface of the top lateral portion in a generally horizontal orientation.

11. A snow blower device comprising:

a housing having a first end portion and a second end portion, the end portions combined by a top lateral portion having a height and a rear lateral portion, wherein the housing has a cavity with an inside and an outside, and the rear lateral portion has a first opening and a second opening;

a rotatable auger combined with the housing and positioned within the cavity to direct snow into a discharge chute having a lumen extending from the inside of the housing to the outside of the housing;

a blade combined with the frame by a first attachment assembly and a second attachment assembly, the first attachment assembly having a first intermediate member and the second attachment assembly having a second intermediate member, the blade movable between a retracted position wherein the blade is raised to the height of the top lateral portion to abut the top lateral portion of the housing and increase the volume of the cavity and an engaged position wherein the blade is lowered and configured to engage a ground surface a predetermined distance ahead of the rotatable auger to plow the predetermined distance ahead of the rotatable auger snow when the snow blower is moved;

at least one of the first attachment assembly and the second attachment assembly further comprising an actuator;

wherein the first attachment assembly extends through the first opening in the rear lateral portion of the housing and the second attachment assembly extends through the second opening the rear lateral portion of the housing.

12. The snow blower device of claim 11 wherein the first end portion is spaced from the second end portion by a first distance, and the first intermediate member is spaced from the second intermediate member by a second distance that is less than the first distance so that the first and second intermediate members are contained by the housing.

13. The snow blower device of claim 11 wherein the first intermediate member and the second intermediate member extend from the blade through the cavity.

14. The snow blower device of claim 11 wherein the first attachment assembly and the second attachment assembly are positioned between the first end portion and the second end portion.

15. The snow blower device of claim 11 wherein the first intermediate member has a first end combined with the blade and a second end combined with the actuator, and wherein the second intermediate member has a first end combined with the blade and a second end combined with a second actuator.

16. The snow blower device of claim 15 wherein at least one of the first actuator and the second actuator is a hydraulic cylinder combined with an external rear portion of the housing.

17. A snow blower device comprising:

a housing having opposing end portions combined by a top lateral portion having a surface and a rear lateral portion having an opening therein, wherein the housing has an inside and an outside, and the one or more lateral portions have an opening therein, wherein the inside of the housing has a volume;

a rotatable auger combined with the housing and positioned within the cavity to direct snow into a discharge chute having a lumen extending from the inside of the housing to the outside of the housing;

a blade combined with the housing by an attachment assembly having an intermediate member and an actuator, the blade movable between a retracted position wherein the blade is raised to abut the top lateral portion of the housing and an engaged position wherein the blade is lowered and configured to engage a ground surface a predetermined distance ahead of the rotatable auger to plow snow the predetermined distance ahead of the rotatable auger when the snow blower is moved;

a proximity sensor configured to help determine when the snow blower is a predetermined distance from an obstacle; wherein a portion of the attachment assembly extends through the opening in the rear lateral portion of the housing.

18. The snow blower device of claim 17 wherein the proximity sensor is an ultrasonic sensor.

19. The snow blower device of claim 17 wherein the proximity sensor is a physical member.

* * * * *